US009394621B2

(12) United States Patent
Inbe et al.

(10) Patent No.: US 9,394,621 B2
(45) **Date of Patent: *Jul. 19, 2016**

(54) METHOD OF TREATING SURFACE OF METAL BASE METALLIC MATERIAL TREATED BY THE SURFACE TREATMENT METHOD AND METHOD OF COATING THE METALLIC MATERIAL

(71) Applicant: Chemetall GmbH, Frankfurt am Main (DE)

(72) Inventors: Toshio Inbe, Osaka (JP); Kazuhiro Makino, Osaka (JP); Hiroshi Kameda, Osaka (JP); Masanobu Futsuhara, Osaka (JP)

(73) Assignee: Chemetall GmbH (DE)

( * ) Notice: Subject to any disclaimer, the term of this patent is extended or adjusted under 35 U.S.C. 154(b) by 0 days.

This patent is subject to a terminal disclaimer.

(21) Appl. No.: 14/467,805

(22) Filed: Aug. 25, 2014

(65) Prior Publication Data

US 2015/0140280 A1 May 21, 2015

Related U.S. Application Data

(63) Continuation of application No. 12/440,265, filed as application No. PCT/JP2007/067537 on Sep. 7, 2007, now Pat. No. 8,916,006.

(30) Foreign Application Priority Data

Sep. 8, 2006 (JP) ..... 2006-244872

(51) Int. Cl.

| | |
|---|---|
| ***C23C 22/48*** | (2006.01) |
| ***C25D 5/34*** | (2006.01) |
| ***C23C 22/34*** | (2006.01) |
| ***C23C 22/73*** | (2006.01) |
| ***C23C 22/82*** | (2006.01) |
| ***C23C 22/83*** | (2006.01) |
| ***C25D 9/08*** | (2006.01) |
| ***C25D 13/20*** | (2006.01) |
| ***C23C 22/05*** | (2006.01) |
| ***C23C 28/00*** | (2006.01) |
| *C23C 22/06* | (2006.01) |

(52) U.S. Cl.

CPC . *C25D 5/34* (2013.01); *C23C 22/05* (2013.01); *C23C 22/34* (2013.01); *C23C 22/73* (2013.01); *C23C 22/82* (2013.01); *C23C 22/83* (2013.01); *C23C 28/00* (2013.01); *C25D 9/08* (2013.01); *C25D 13/20* (2013.01); *C23C 2222/20* (2013.01); *Y10T 428/24628* (2015.01)

(58) Field of Classification Search

CPC ..... C25D 5/34; C25D 9/08; C25D 13/20; C23C 28/00; C23C 22/05; C23C 22/73; C23C 22/82; C23C 22/83; C23C 2222/20; C23C 22/34; C23C 22/361

USPC ..... 148/247

See application file for complete search history.

(56) References Cited

U.S. PATENT DOCUMENTS

| | | | | |
|---|---|---|---|---|
| 5,584,946 | A | 12/1996 | Karmaschek et al. | |
| 6,905,590 | B2 | 6/2005 | Nojiri et al. | |
| 7,250,193 | B2 | 7/2007 | Matsukawa et al. | |
| 7,811,366 | B2 | 10/2010 | Inbe et al. | |
| 2004/0144451 | A1* | 7/2004 | Matsukawa | C23C 22/34 148/247 |
| 2004/0170840 | A1 | 9/2004 | Matsukawa et al. | |
| 2006/0147735 | A1 | 7/2006 | Matsukawa et al. | |
| 2006/0185769 | A1 | 8/2006 | Nakayama et al. | |
| 2010/0038250 | A1 | 2/2010 | Matsukawa et al. | |

FOREIGN PATENT DOCUMENTS

| | | | |
|---|---|---|---|
| EP | 1 455 002 | A1 | 9/2004 |
| JP | 60-021384 | A | 2/1985 |
| JP | 08-134661 | A | 5/1996 |
| JP | 08-510505 | A | 11/1996 |
| JP | 2004-190121 | A | 7/2004 |
| JP | 2004-218070 | A | 8/2004 |
| JP | 2005-002370 | A | 1/2005 |
| JP | 2005-325401 | A | 11/2005 |
| JP | 2006-161115 | A | 6/2006 |
| JP | 2006-183128 | A | 7/2006 |

* cited by examiner

*Primary Examiner* — Lois Zheng
(74) *Attorney, Agent, or Firm* — Jeremy J. Kliebert

(57) ABSTRACT

A metal surface treatment method for a metal base material in order to improve the uniformity of a cathodic electrodeposition coating film, the method including: a surface treatment step for forming a chemical conversion film on a metal base material by contacting the metal base material with a metal surface treatment composition including zirconium and/or titanium ions and an adhesive imparting agent characterized in being at least one selected from the group consisting of (A) silicon-containing compound, (B) adhesive imparting metal ion, and (C) adhesive imparting resin; and a heating/drying step to heat and dry the metal base material, on which the chemical conversion film is formed, at 60° C. to 190° C. for at least 30 seconds.

10 Claims, 2 Drawing Sheets

METHOD OF TREATING SURFACE OF METAL BASE METALLIC MATERIAL TREATED BY THE SURFACE TREATMENT METHOD AND METHOD OF COATING THE METALLIC MATERIAL

This application is a continuation of U.S. Ser. No. 12/440,265 filed Dec. 17, 2009, hereby incorporated by reference in its entirety, which is a §371 of PCT/JP2007/067537 filed Sep. 7, 2007, which claims priority from JP 2006-244872 filed Sep. 8, 2006.

TECHNICAL FIELD

The present invention relates to a surface treatment method which is conducted prior to cathodic electrodeposition coating, a metal material which has been treated by the surface treatment method, and a coating method using the metal material.

BACKGROUND ART

Cathodic electrodeposition coating can apply a coating film onto fine portions of metal base materials with curves and bag portions, formed by fold-processing metal plates, and also plural curves such as connecting portions between metal plates. The cathodic electrodeposition coating can also form a coating film automatically and continuously, and therefore, has been widely practically applied as a method of base coating for large-size metal base materials with plural curves and bag portions such as car bodies in particular. The cathodic electrodeposition coating is performed by immersing a material to be coated into a cathodic electrodeposition coating composition as a negative electrode and applying a voltage thereto. A coating film is deposited in the process of the cathodic electrodeposition coating by an electrochemical reaction so that a component in the electrodeposition coating composition moves to the surface of the material to be coated by cataphoresis and a cathodic electrodeposition coating film is deposited on the surface of the material to be coated. Since, the deposited coating film has an insulating property, electric resistance of the coating film increases as the deposition of the coating film progresses in the process of the cathodic electrodeposition coating and the thickness of the coating film increases. As a result, the deposition of the coating film decreases at the site and the deposition of the coating film begins alternatively at undeposited sites. In this way, the coating film deposits sequentially at undeposited sites to thereby complete the electrodeposition coating film over the entire material to be coated. The property to form a continuous electrodeposition coating film by way that an insulating coating film is sequentially deposited, at undeposited sites of a metal base material of a material to be coated is referred to as "uniformity" in this specification. The cathodic electrodeposition coating sequentially forms an insulating coating film on the surface of a material to be coated as described above, and therefore, theoretically has an infinite uniformity and can form a uniform coating film on all portions of materials to be coated. However, the uniformity of electrodeposition coating film tends to degrade considerably in cases where the electric resistance of the coating film does not increase for some reason even when the coating film is deposited on the surface of material to be coated. Consequently, the nonuniformity generated in film thickness significantly affects the corrosion resistance etc. When the cathodic electrodeposition coating film is applied to metal base materials, surface treatment is typically applied in order to improve various properties such as corrosion resistance and coating adhesion. Chromic phosphate based surface treatment compositions, which have heretofore been employed for surface treatment in view of improvement in coating adhesion and corrosion resistance, have recently been pointed out for their environmental impact due to the hazardous properties of chromium. Accordingly, zinc phosphate based surface treatment compositions have been employed as a surface treatment agent containing no chromium (e.g., see Patent Document 1). However, the zinc phosphate based surface treatment compositions have a high metal ion content as well as a high acid content and exhibit very strong reactivity and thus are undesirable in view of economy and workability such as expensive wastewater treatment. In addition, during chemical conversion treatment of metal using zinc phosphate based surface treatment agents, water-insoluble salts are generated and separate out as a deposit inside chemical conversion treatment baths. Such a deposit is referred to as "sludge" in general and is problematic in terms of higher cost for removal and disposal of the sludge. Furthermore, phosphate ion may possibly provide an environmental load such as nutrient enrichment of rivers and oceans. Additionally, surface conditioning is necessary for surface treatment by zinc phosphate based surface treatment compositions and is problematic in terms of longer processes of surface treatment. Surface treatment compositions including metal surface treatment agents of zirconium and/or titanium compounds are publicly known as substitutes for chromic phosphate based or zinc phosphate based surface treatment compositions. For example, Patent Document 2 discloses an aqueous surface treatment liquid for surface-treating each independently or at least two simultaneously of metal materials selected from iron materials, zinc materials, aluminum materials, and magnesium materials, in which the surface treatment liquid for metal surface is characterized in containing at least one compound selected from zirconium compounds and titanium compounds in an amount of 5 ppm to 5000 ppm as the metal element and also free fluorine ion in an amount of 0.1 ppm to 100 ppm, and has a pH of 2 to 6. In accordance with the surface treatment liquid, a surface treatment film with superior corrosion resistance after coating can be allegedly deposited on a metal surface of each independently or two to four simultaneously of iron materials, zinc materials, aluminum materials, and magnesium materials using a treatment bath containing no environmental harmful component without generating the sludge, which has been impossible in the prior art. Furthermore, Patent Document 3 discloses a pretreatment method for coating to treat a material to be treated by a chemical conversion treatment agent to form a chemical conversion film, in which the pretreatment method for coating is characterized in that the chemical conversion treatment agent contains at least one selected from the group consisting of zirconium, titanium, and hafnium; fluorine, and at least one selected from the group consisting of amino group-containing silane coupling agents, hydrolysates thereof, and polymers thereof. In accordance with the pretreatment method for coating, the environmental load may be lower due to employing no zinc phosphate based treatment agent and a chemical conversion film can be formed with superior film adhesion even onto iron base materials to which pretreatment had been heretofore inadequate using chemical conversion treatment agents containing zirconium.

Patent Document 4 discloses a pretreatment method for coating to form a chemical conversion film on surface of car bodies of material to be treated prior to electrodeposition coating, in which the pretreatment method for coating is characterized in applying a degreasing treatment and a cleaning treatment to the car bodies, and applying a chemical conversion treatment using a chemical conversion treatment liquid, followed by warming the car bodies to the temperature equivalent to that of the electrodeposition liquid during the electrodeposition coating. In accordance with the pretreatment method for coating, allegedly, electrodeposition uniformity can be improved and quality of the coating film can be improved. Patent Document 5 discloses a method of pretreating a surface of aluminum or alloy thereof prior to another stable corrosion-prevention chemical conversion treatment, preferably, chromate salt treatment, chromium non-containing chemical conversion treatment by a reactive organic polymer and/or a compound of titanium, zirconium, and/or hafnium elements, or phosphate treatment by an acidic zinc-containing phosphate treatment bath, in which the method is characterized in that the surface is brought into contact with an aqueous treatment solution which contains a fluoro complex of boron, silicon, titanium, zirconium or hafnium elements, each independently or a mixture thereof, in an amount of 100 mg/L to 4000 mg/L, preferably 200 mg/L to 2000 mg/L as the concentration of total fluoro anion and has a pH value of 0.3 to 3.5, preferably 1 to 3; and a method is disclosed as one embodiment thereof in which the treatment solution, having a temperature of 15° C. to 60° C., is applied to aluminum surface by a spray, immersion, or non-rinsing process, and the treated aluminum surface is dried at a temperature of 40° C. to 85° C. In accordance with the method, allegedly, contact resistance of the metal surface can be made uniform and weld can be made uniform at resistance welding.

[Patent Document 1] Japanese Patent No. 3088623

[Patent Document 2] Japanese Unexamined Patent Application, First Publication No. 2004-190121

[Patent Document 3] Japanese Unexamined Patent Application, First Publication No. 2004-218070

[Patent Document 4] Japanese Unexamined Patent Application, First Publication No. 2006-183128

[Patent Document 5] Japanese Unexamined Patent Application, First Publication No. 08-510505

DISCLOSURE OF THE INVENTION

Problems to be Solved by the Invention

However, in the zirconium based surface treatment composition of Patent Document 2, there is a problem in that nonuniformity of coating film arises such that, depending on the kind of metal base material, the coating film cannot be formed uniformly in the cathodic electrodeposition coating after surface treatment. There is also a problem in that uniform film can be sparingly formed in SPC steel plate, high-tension steel plate, etc. with higher silicon contents and the corrosion resistance is inferior to those based on zinc phosphate. When the coating film cannot be formed uniformly, the effect of the electrodeposition coating cannot be obtained at the sites where the coating film is not sufficiently formed, causing degradation of corrosion resistance etc. On the other hand, although the amount of coating film can be increased over the entire surface of metal base material by increasing the voltage, it is undesirable in view of cost. In addition, there is a problem of inferior appearance due to pinholes or craters. The reason being that spark discharge is likely to occur in hydrogen gas since discharge voltage of hydrogen gas generated on the side of the material to be coated during the cathodic electrodeposition coating, is lower in galvanized steel plate than that of iron steel plate. Furthermore, the coating pretreatment method of Patent Document 3 does not define the coating process and also does not disclose or suggest the problem with respect to corrosion resistance and electrodeposition uniformity using a chemical conversion film alone, although a coating pretreatment method with less environmental load and that is capable of treating all metals such as iron, zinc and aluminum with chemical conversion treatment agent is disclosed. In addition, in the invention described in Patent Document 4, the temperature to warm the car bodies remains within the level of electrodeposition coating material at highest and is specifically 25° C. to 35° C. Patent Document 4 does not disclose or suggest heat treatment of the car bodies at temperatures higher than this temperature. Furthermore, the method described in Patent Document 5 relates to a method carried out as a pretreatment of weld and is fundamentally different from chemical conversion treatment carried out as a pretreatment of electrodeposition coating. Accordingly, the method described in Patent Document 5 does not provide any suggestion with respect to improvement of uniformity of an electrodeposition coating film. The present invention has been made in view of the problems described above. It is an object of the present invention to provide a coating method for a metal base material with superior uniformity and a surface treatment method which is conducted prior to cathodic electrodeposition coating, in which the surface treatment method can improve uniformity of a cathodic electrodeposition coating film.

Means for Solving the Problems

The present inventors have encountered a problem that when zirconium based and titanium based metal surface treatment compositions are used for metal base materials, a coating film cannot be uniformly formed during the subsequent cathodic electrodeposition coating, i.e. uniformity degrades. The problem described above was remarkable when used for iron-type metal base materials such as SPC steel plates. The present inventors have thoroughly investigated based on this knowledge. As a result, it has been discovered that the decrease of uniformity is caused mainly from the fact that film resistivity of the chemical conversion film is considerably lower than that of conventional zinc phosphate based coating film and additionally from the fact that components of the chemical conversion film itself elute during the cathodic electrodeposition coating and then the soluble substance permeate into the electrodeposition coating film to effect an electrolytic influence and further to decrease the film resistivity of the electrodeposition coating film. Then the present inventors have discovered, in the surface treatment to form a chemical conversion film on a metal base material by contacting a metal surface treatment composition which contains zirconium ion and/or titanium ion and an adhesive imparting agent, that the uniformity of the cathodic electrodeposition coating film is improved using the metal material when (a) the metal base material, on which the chemical conversion film has been formed, is treated to dry at a certain temperature for a certain time, (b) the metal base material, on which the chemical conversion film has been formed, is treated with hot water at a certain temperature for a certain time, (c) the metal base material is surface-treated at a certain temperature for a certain time, or (d) the metal base material is treated by cathodic electrolysis at a certain applied current density under a certain applied voltage during the surface treatment, thereby achieving the present invention. That is, the decrease in the film resistivity of the chemical conversion film is prevented and thereby the uniformity of the cathodic electrodeposition coating film is improved by way of conducting the treatment described above. Specifically, the present invention is as follows. In a first aspect of the present invention, a surface treatment method for improving the uniformity of a cathodic electrodeposition coating film, in which the surface treatment method forms a chemical conversion film on a metal base material by contacting the metal base material with a metal surface treatment composition comprising zirconium and/or titanium ions and an adhesive imparting agent characterized in being at least one selected from the group consisting of (A) silicon-containing compound, (B) adhesive imparting metal ion, and (C) adhesive imparting resin, in which the surface treatment method includes a step of surface treatment whereby the metal surface treatment composition comes into contact with the metal base material, and a step of post-treatment of heat-treating the metal base material after the step of surface treatment, and in which the post-treatment process is at least one selected from the group consisting of (1) a process of dry-treating the metal base material under atmospheric pressure or pressurized conditions at 60° C. to 190° C. for at least 30 seconds, and (2) a process of heat-treating the metal base material under atmospheric pressure or pressurized conditions in hot water at 60° C. to 120° C. for 2 seconds to 600 seconds. In a second aspect of the present invention, a surface treatment method forms a chemical conversion film on a metal base material by bringing the metal base material into contact with a metal surface treatment composition containing zirconium and/or titanium ions and an adhesive imparting agent characterized in being at least one selected from the group consisting of (A) silicon-containing compound, (B) adhesive imparting metal ion, and (C) adhesive imparting resin, in which the metal base material makes contact with the metal surface treatment composition under atmospheric pressure or pressurized conditions at 60° C. to 120° C. for 2 seconds to 600 seconds. In a third, aspect of the present invention, a surface treatment method forms a chemical conversion film on a metal base material by bringing the metal base material into contact with a metal surface treatment composition containing zirconium ions and/or titanium ions and an adhesive imparting agent characterized in being at least one selected from the group consisting of (A) silicon-containing compound, (B) adhesive imparting metal ion, and (C) adhesive imparting resin, in which at the time of surface treatment, in the metal surface treatment composition, cathode electrolytic treatment is conducted on the metal base material under atmospheric pressure or pressurized conditions with an applied voltage of 0.1 V to 40 V and an applied current density of 0.1 A/dm$^2$ to 30 A/dm$^2$. According to a fourth aspect, in the surface treatment method according to any one of the first to third aspects, the (A) silicon-containing compound is of at least one selected from the group consisting of silica, silicofluoride, a soluble silicate compound, silicate esters, alkyl silicates, and a silane coupling agent. According to a fifth aspect, in the surface treatment method according to the fourth aspect, the silane coupling agent is aminosilane and/or a hydrolysis-polycondensate of the aminosilane, having at least one amino group in a molecule, the total amount of the zirconium and/or titanium ions in the metal surface treatment composition is 10 ppm to 10000 ppm based on metal element content, the total amount of the aminosilane and/or hydrolysis-polycondensate of the aminosilane in the metal surface treatment composition is 1 ppm to 2000 ppm based on silicon element content, and the ratio of the total amount of zirconium and/or titanium elements to the total amount of silicon element contained in the aminosilane and/or hydrolysis-polycondensate of the aminosilane is 0.5 to 500. The term "based on metal element content" refers to the amount of a target metal element calculated by multiplying a conversion factor of the metal element (factor to convert an amount of metal compound into an amount of metal element, specifically, a value of an atomic mass of metal element of the metal compound divided by the molecular mass of the metal compound) by the amount of the metal compound. For example, the zirconium concentration based on metal element content is calculated as 44 ppm from 100×(91÷205) in the case of 100 ppm of a complex ion $ZrF_6^{2-}$ (molecular mass: 205). Furthermore, the term "based on silicon element content" refers to the amount of target silicon metal element calculated by multiplying a conversion factor of silicon element (factor to convert an amount of silicon compound into an amount of silicon element, specifically, a value of an atomic mass of silicon element of the silicon compound divided by the molecular mass of the silicon compound) by the amount of the silicon compound. For example, the concentration based on silicon element content is calculated as 16 ppm from 100×(28÷179) in the case of 100 ppm of aminopropyltrimethoxysilane (molecular mass: 179). Furthermore, based on a concentration of 100 ppm of silicon element, the concentration of aminopropyltrimethoxysilane can be calculated as 639 ppm from 100÷(28÷179). In addition, the term "total amount" indicates a total of the entire amounts of the compounds existing in the metal surface treatment composition, including cases where any one of amounts of the compounds is zero. According to a sixth aspect, in the surface treatment method according to any one of the first to fifth aspects, the (B) adhesive imparting metal ion is at least one metal ion selected from the group consisting of magnesium, zinc, calcium, aluminum, gallium, indium, copper, iron, manganese, nickel, cobalt, silver, and tin. According to a seventh aspect, in the surface treatment method according to any one of the first to sixth aspects, the (C) adhesive imparting resin is at least one selected from the group consisting of a polyamine compound, a blocked isocyanate compound and a melamine resin. According to an eighth aspect, in the surface treatment method according to the seventh aspect, the polyamine compound contains at least one constituent unit represented by the chemical formulas (1), (2) and/or (3) shown below, and the ratio of the total amount of the zirconium and/or titanium ions to the mass of the polyamine compound is 0.1 to 100, and in which (1)

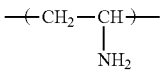

(2)

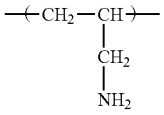

(3)

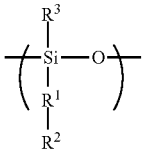

in the chemical formula (3), $R^1$ is an alkylene group having 1 to 6 carbon atoms, $R^2$ is a substituent group represented by the following chemical formulas (4) to (6) shown below, and $R^3$ is a hydroxyl group, an alkoxy group having 1 to 6 carbon atoms or an alkyl group having 1 to 6 carbon atoms, and (4)

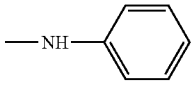

(5)

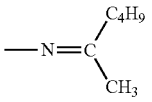

(6)

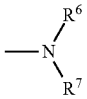

in the chemical formula (6), $R^6$ is a hydrogen atom, an aminoalkyl group having 1 to 6 carbon atoms or an alkyl group having 1 to 6 carbon atoms, and $R^7$ is a hydrogen atom or an aminoalkyl group having 1 to 6 carbon atoms. According to a ninth aspect, in the surface treatment method according to any one of the first to eighth aspects, the metal surface treatment composition has a pH of 1.5 to 6.5. According to a tenth aspect, in the surface treatment method according to any one of the first to ninth aspects, the metal surface treatment composition further contains at least one oxidizing agent selected from the group consisting of nitric acid, nitrous acid, sulfuric acid, sulfurous acid, persulfate, phosphoric acid, hydrochloric acid, bromic acid, chloric acid, hydrogen peroxide, $HMnO_4$, $HVO_3$, $H_2WO_4$, $H_2MoO_4$, and respective salt of each thereof. According to an eleventh aspect, in the surface treatment method according to any one of the first to tenth aspects, the metal surface treatment composition further contains at least one kind of stabilizing agent selected from the group consisting of a hydroxy acid compound, an amino acid compound, an aminocarboxylic acid compound, an aromatic acid compound, a sulfonic acid compound, and a polyvalent anion.

In a twelfth aspect of the present invention, a metal material is obtained by treating a metal base material with the surface treatment method according to any one of the first to eleventh aspects. In a thirteenth aspect of the present invention, a coating method for a metal base material in which the metal material according to the twelfth aspect is electropainted with a cathodic electrodeposition coating material. According to a fourteenth aspect, in the coating method according to the thirteenth aspect, the cathodic electrodeposition coating material contains a modified epoxy resin and a curing agent.

Effects of the Invention

In accordance with the present invention, (a) the chemical conversion film is formed on the metal base material and then heat drying is conducted at a certain temperature for a certain time, therefore, soluble substances (metal oxides or ion components), which typically elute during cathodic electrodeposition to cause degradation of the uniformity of electrodeposition coating material due to lowering the electric resistivity of the electrodeposition coating film, stabilize in the chemical conversion film and the electrodeposition uniformity is improved without lowering the film resistivity of the chemical conversion film;

(b) the chemical conversion film is formed on the metal base material and then the treatment is conducted in hot water at a certain temperature for a certain time, therefore, the soluble substances stabilize in the chemical conversion film and the film resistivity of the chemical conversion film does not decrease thus the electrodeposition uniformity is improved;

(c) the metal surface treatment is conducted at a certain temperature for a certain time using the metal surface treatment composition, therefore, the soluble substances are unlikely to form in the chemical conversion film and the film resistivity of the chemical conversion film does not decrease thus the electrodeposition uniformity is improved; and (d) the cathode electrolytic treatment is conducted on the metal base material under a certain applied, voltage at a certain applied current density during the surface treatment, therefore, the soluble substances are unlikely to form in the chemical conversion film and the film resistivity of the chemical conversion film does not decrease thus the electrodeposition uniformity is improved.

PREFERRED MODE FOR CARRYING OUT THE INVENTION

Figure 1:
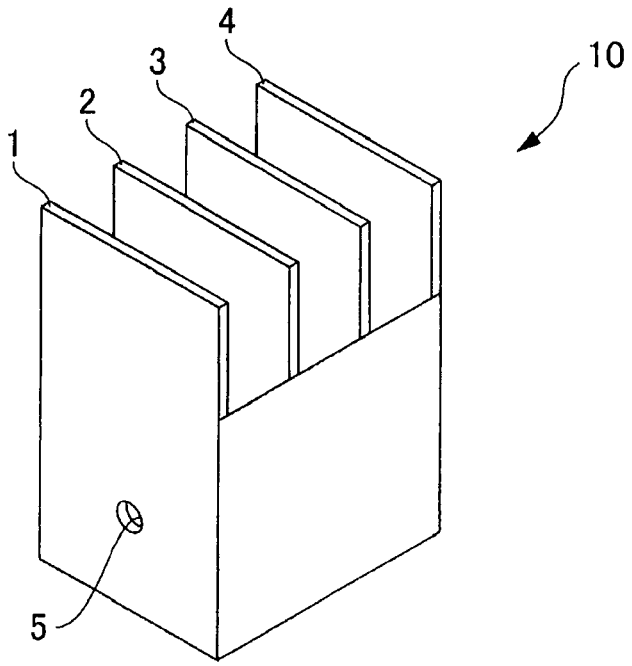
FIG. 1 is a perspective view exemplarily showing a box used when uniformity is evaluated.
Figure 2:
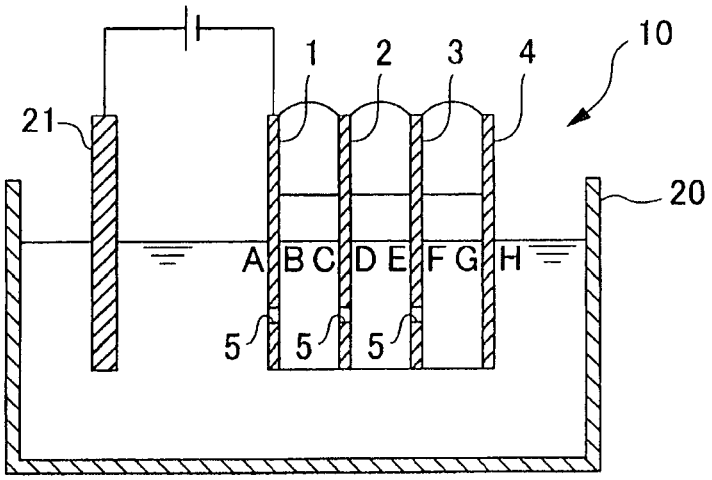
FIG. 2 is a view showing schematically the evaluation of uniformity.

Embodiments of the present invention are explained in detail below.

First Embodiment

First embodiment of the present invention is explained in detail.

Surface Treatment Method

In this embodiment, the surface treatment method of treating the surface of the metal base material consists of a step of surface treatment in which the metal surface treatment composition, containing zirconium and/or titanium ions and an adhesive imparting agent, comes into contact with the metal base material to form a chemical conversion film and a heating/drying step in which the metal base material, on which the chemical conversion film has been formed, is heated and dried.

Step of Surface Treatment

In the step of surface treatment according to this embodiment, the metal surface treatment composition, containing zirconium and/or titanium ions and an adhesive imparting agent, is made to contact the surface of the metal base material thereby forming a chemical conversion film thereon. The method of forming a chemical conversion film is not particularly limited and can be conducted by contacting a surface treatment liquid, containing the metal surface treatment composition described later, with the metal base material. Examples of the method of forming a chemical conversion film include dipping methods, spray methods, roll coating methods, flowing treatment methods, etc. The treatment temperature in the step of surface treatment is preferably within the range of 20° C. to 70° C., more preferably within the range of 30° C. to 50° C. A temperature below 20° C. may result in insufficient formation of the film and be undesirable in that coolers etc. are necessary to control the temperature during the summer season, and a temperature above 70° C. is not particularly effective and is no more than economically disadvantageous. The treatment time in the step of surface treatment is preferably within the range of 2 seconds to 1100 seconds, more preferably within the range of 30 seconds to 120 seconds. A treatment time below 2 seconds is undesirable in that the film is unobtainable in a sufficient amount and a treatment time above 1100 seconds is not desirable since a greater effect is not obtainable with an increase in the amount of film.

Metal Surface Treatment Composition

The metal surface treatment composition, able to be used, in the process to form the chemical conversion film, is not particularly limited as long as the composition contains zirconium and/or titanium ions, and preferably, contains zirconium and/or titanium ions and the adhesive imparting agent as essential components, and an oxidizing agent, a stabilizing agent, fluorine ion, and a guanidine compound as an organic inhibitor as optional components.

Zirconium and/or Titanium Ions

The zirconium and/or titanium ions, contained in the metal surface treatment composition, are a component for forming the chemical conversion film. The corrosion resistance and abrasion resistance of the metal material can be improved by forming the chemical conversion film, containing the zirconium and/or titanium elements, on the metal material. When the surface treatment is conducted for the metal material by the metal surface treatment composition containing zirconium and/or titanium ions according to this embodiment, a dissolving reaction occurs for the metal which constitutes the metal material. When the metal-dissolving reaction occurs in the case of the metal surface treatment composition containing a fluoride of zirconium and/or titanium, the metal ion, which has dissolved into the metal surface treatment composition, draws out the fluorine of $ZrFe_6^{2-}$ and/or $TiF_6^{2-}$ and the pH rises at the interface, thereby generating a hydroxide or oxide of zirconium and/or titanium. And it is believed that the hydroxide or oxide of zirconium and/or titanium deposits on the surface of the metal material. The metal surface treatment composition according to this embodiment is a reactive chemical conversion treatment agent, and therefore, can be used for dipping treatment of metal materials having complex shapes. Furthermore, since a chemical conversion film can be obtained that firmly adheres to the metal material through a chemical reaction, water washing can be carried out after the treatment. The zirconium compound is not particularly limited; examples thereof include fluorozirconic acid, fluorozirconates such as potassium fluorozirconate and ammonium fluorozirconate; zirconium fluoride, zirconium oxide, zirconium oxide colloid, zirconyl nitrate, and zirconium carbonate. The titanium compound is not particularly limited; examples thereof include fluorotitanic acid, fluorotitanates such as potassium fluorotitanate and ammonium fluorotitanate; titanium fluoride, titanium oxide, and titanium alkoxides.

Amount of Zirconium and/or Titanium Ions

The total amount of the zirconium and/or titanium ions in the metal surface treatment composition according to this embodiment is preferably within the range of 10 ppm to 10000 ppm based on metal element content, more preferably within the range of 50 ppm to 5000 ppm. When the amount is below 10 ppm, a sufficient film may be unobtainable on the metal base material, on the other hand, when the amount is above 10000 ppm, it is economically disadvantageous since no further effect can be expected.

Adhesive Imparting Agent

The adhesive imparting agent, included into the metal surface treatment composition according to this embodiment, is at least one selected from the group consisting of (A) silicon-containing compound, (B) adhesive imparting metal ion, and (C) adhesive imparting resin. The coating adhesion and the corrosion resistance after coating can be remarkably improved by including these compounds.

(A) Silicon-Containing Compound

The (A) silicon-containing compound is not particularly limited; examples thereof include silicas such as water-dispersible silica, silicofluorides such as hydrofluorosilicic acid, ammonium hexafluorosilicate, and sodium silicofluoride; water-soluble silicate compounds such as sodium silicate, potassium silicate, and lithium silicate; silicate esters; alkyl silicates such as diethyl silicate; and silane coupling agents. The amount of the silicon-containing compound in the metal surface treatment composition is preferably 1 ppm to 5000 ppm, more preferably 20 ppm to 2000 ppm. An amount of the silicon-containing compound below 1 ppm is undesirable in that the corrosion resistance of the resulting chemical conversion film degrades. An amount above 5000 ppm is economically disadvantageous since no further effect can be expected and also may possibly deteriorate the adhesion after-coating.

Silica

Silica is not particularly limited, and water-dispersible silica can be preferably used due to higher dispersibility in the metal surface treatment composition. The water-dispersible silica is not particularly limited; examples thereof include sphere-shape silica, chain-shape silica, aluminum-modified silica, etc. which contain lower amounts of impurities such as sodium. The sphere-shape silica is not particularly limited; examples thereof include colloidal silicas such as Snowtex N, Snowtex O, Snowtex OXS, Snowtex UP, Snowtex XS, Snowtex AK, Snowtex OUP, Snowtex C, and Snowtex OL (each trade name, manufactured by Nissan Chemical Industries, Ltd.) and fumed silicas such as Aerosol (trade name, manufactured by Japan Aerosol Co.). The chain-shape silica is not particularly limited; examples thereof include silica sols such as Snowtex PS-M, Snowtex PS-MO, and Snowtex PS-SO (each trade name, manufactured by Nissan Chemical Industries, Ltd.). The aluminum-modified silica may be commercially available silica sols such as Adelite AT-20A (trade name, manufactured by Asahi Denka Kogyo Co.). The silicon-containing compounds may be used alone, but can exhibit an excellent effect when used in combination with the (B) adhesive imparting metal ion and/or the (C) adhesive imparting resin.

Silane Coupling Agent

The silane coupling agent is particularly preferably aminosilanes having at least one amino group per one molecule. The amino silane may be any hydrolysis-polycondensate containing a monomer or dimer, and hydrolysis-polycondensate of aminosilanes is preferable since being water-washable before the cathodic electrodeposition coating.

Aminosilane

It is believed that the aminosilanes having at least one amino group per one molecule contribute to improve the adhesion when incorporated into the chemical conversion film due to the presence of an amino group. Specific examples of the aminosilanes having at least one amino group per one molecule include N-(2-aminoethyl)-3-aminopropyl methyldimethoxysilane, N-(2-aminoethyl)-3-aminopropyl trimethoxysilane, N-(2-aminoethyl)-3-aminopropyl triethoxysilane, 3-aminopropyl trimethoxysilane, 3-aminopropyl triethoxysilane, 3-triethoxysilyl-N-(1,3-dimethyl-butylidene)propylamine, N-phenyl-3-aminopropyl trimethoxysilane, and hydrochloride of N-(vinylbenzyl)-2-aminoethyl-3-aminopropyl trimethoxysilane. These compounds improve the corrosion resistance after coating since being excellent in adsorption to metal base materials and adhesion to electrodeposition coating films. Commercially available silane coupling agents containing an amino group are usable such as KBM-403, KBM-602, KBM-603, KBE-603, KBM-903, KBE-903, KBE-9103, KBM-573, KBP-90 (each trade name, manufactured by Shin-Etsu Chemical Co.) and XS1003 (trade name, manufactured by Chisso Co.).

Hydrolysis-Polycondensate of Aminosilane

The metal surface treatment composition according to this embodiment may contain a hydrolysis-polycondensate of aminosilane. The hydrolysis-polycondensate of aminosilane can improve the adhesion of both the surface of metal base material and the coating film formed thereafter since it affects the both. The molecular mass of the hydrolysis-polycondensate of aminosilane, which is not particularly limited, is preferably higher, since a higher molecular mass tends to allow easier incorporation into the hydroxide or oxide of zirconium and/or titanium. It is therefore preferred, that the aminosilane is allowed to react under conditions conducive for hydrolysis and polycondensation when the aminosilane undergoes the hydrolysis polycondensation reaction. The conditions conducive for hydrolysis and polycondensation are, for example, reaction conditions where the solvent is a catalyst-containing aqueous solvent such as alcohols and acetic acid, reaction conditions where an aminosilane is compounded to result in co-condensation rather than mono-condensation as described above, and the like. Furthermore, a higher molecular mass hydrolysis-polycondensate and a higher polycondensation rate can be obtained under conditions of higher aminosilane concentration. Specifically, the polycondensation is preferably carried out within the range of aminosilane concentration of 5 mass % to 50 mass %.

Total Amount of Aminosilane and/or Hydrolysis-Polycondensate of Aminosilane

The total amount of aminosilane and/or hydrolysis-polycondensation of aminosilane is preferably 1 ppm to 2000 ppm based on silicon element content, more preferably 10 ppm to 200 ppm. When the total amount is below 1 ppm, the adhesion is lowered, and when the total amount is above 2000 ppm, it is economically disadvantageous since no further effect can be expected.

Mass Ratio of Zirconium Element and/or Titanium Element to Silicone Element Contained in Aminosilane and/or Hydrolysis-Polycondensate of Aminosilane The mass ratio of the zirconium element and/or titanium element contained in the metal surface treatment composition to the silicone element contained in the aminosilane and/or hydrolysis-polycondensate of aminosilane is preferably 0.5 to 500. When the mass ratio is below 0.5, the adhesion and corrosion resistance degrade since formation of the chemical conversion film by zirconium and/or titanium is inhibited. When the mass ratio is above 500, the adhesion cannot be sufficiently confirmed since the aminosilane and/or hydrolysis-polycondensate of aminosilane is not sufficiently incorporated into the chemical conversion film.

(B) Adhesive Imparting Metal Ion

The adhesion and corrosion resistance of the chemical conversion film can be improved by adding the (B) adhesive imparting metal ion to the metal surface treatment composition according to this embodiment. The adhesive imparting metal ion may be at least one selected from the group consisting of magnesium, zinc, calcium, aluminum, gallium, indium, copper, iron, manganese, nickel, cobalt, silver, and tin. Among these, aluminum and tin ions are preferable since they are capable of improving the adhesion and corrosion resistance of the chemical conversion film. The amount of the adhesive imparting metal ion is preferably 1 ppm to 5000 ppm in the metal surface treatment composition, more preferably 20 ppm to 2000 ppm. An amount below 1 ppm is undesirable since the corrosion resistance may degrade in the resulting chemical conversion film. An amount above 5000 ppm is economically disadvantageous since no further effect appears and the post-coating adhesion may degrade. Furthermore, an amount below 20 ppm may result in insufficient adhesion between the chemical conversion film and the coating film, and with an amount above 2000 ppm it may be difficult for zirconium and/or titanium to deposit in the chemical conversion film. Furthermore, tin ion can improve the uniformity when the cathodic electrodeposition coating is conducted after forming the chemical conversion film using the metal surface treatment composition. The mechanism to improve the uniformity is not necessarily clear, but is considered as follows. It is considered that the tin ion is barely influenced by the surface condition of steel plate compared to zirconium ion and/or titanium ion, for example, and tin can deposit to form a film even on the portions where zirconium ion and/or titanium ion sparingly form the chemical conversion film, consequently, the electrodeposition coating can be carried out with superior uniformity. The tin ion, contained in the metal surface treatment composition according to this embodiment, is preferably a divalent cation. The intended effect may be possibly unobtainable for a tin ion having a valence other than this valence. The concentration of the tin ion preferably ranges from 0.005 to 1 times the total amount of the zirconium ion and/or titanium ion. When the value is below 0.005, the effect of the addition may be unobtainable, and when the value is above 1, the deposition of zirconium and/or titanium may be difficult. The preferable upper and lower limits thereof are respectively 0.02 and 0.2. In this regard, the total amount of the zirconium ion and/or titanium ion and the tin ion is preferably at least 15 ppm when the tin ion is included. In addition, the compound to supply the tin ion is not particularly limited; examples thereof include tin sulfate, tin acetate, tin fluoride, tin chloride, and tin nitrate. These compounds may be used alone or in combination of two or more.

(C) Adhesive Imparting Resin

The (C) adhesive imparting resin is at least one selected from the group consisting of a polyamine compound, a blocked isocyanate compound, and a melamine resin. The adhesion of the coating film can be significantly improved by including these compounds. The amount of the adhesive imparting resin is preferably 1 ppm to 5000 ppm in the metal surface treatment composition, more preferably 20 ppm to 2000 ppm. An amount below 1 ppm is undesirable since the corrosion resistance degrades in the resulting chemical conversion film. An amount above 5000 ppm is economically disadvantageous since no further effect appears and the post-coating adhesion may degrade.

Polyamine Compound

The polyamine compound, contained in the metal surface treatment composition according to this embodiment, is a polymer compound which has plural amino groups (preferably, primary amino group) per one molecule. The polyamine compound, containing amino groups, acts on both of the chemical conversion film and the coating film formed thereafter, thus the adhesion of the both can be improved. The molecular mass of the polyamine compound, which is not particularly limited, is preferably 150 to 500000, more preferably 5000 to 70000. A molecular mass below 150 is undesirable since the chemical conversion film with sufficient film adhesion is unobtainable. A molecular mass above 500000 may possibly inhibit the formation of the film.

Structural Formula of Polyamine Compound

Examples of the polyamine compound include those having the structures below. That is, the polyamine compound is those having at least partially one of the structural units expressed by the chemical formulas (1), (2) and (3) below.

(1)

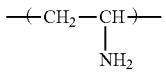

(2)

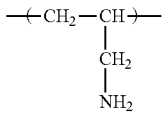

(3)

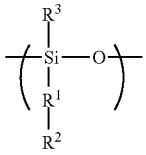

in the chemical formula (3), $R^1$ is an alkylene group having 1 to 6 carbon atoms; $R^2$ is a substituent group expressed by the chemical formulas (4) to (6); $R^3$ is a hydroxyl group, an alkoxy group having 1 to 6 carbon atoms, or an alkyl group having 1 to 6 carbon atoms.

(4)

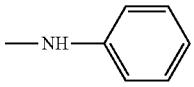

(5)

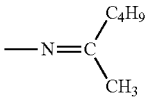

(6)

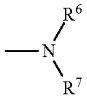

in the chemical formula (6), $R^6$ is a hydrogen atom, an aminoalkyl group having 1 to 6 carbon atoms, or an alkyl group having 1 to 6 carbon atoms; and $R^7$ is a hydrogen atom or an aminoalkyl group having 1 to 6 carbon atoms. Preferably, the polyamine compound is a polyvinylamine resin consisting only of the structural unit expressed by the chemical formula (1), a polyallylamine resin consisting only of the structural unit expressed by the chemical formula (2), or a polysiloxane consisting only of the structural unit expressed by the chemical formula (3), in view of the excellent effect to improve the adhesion. Examples of the polysiloxane include hydrolysis-polycondensates and salts of N2-(aminoethyl)-3-aminopropyl methyldimethoxysilane, N2-(aminoethyl)-3-aminopropyl trimethoxysilane, N2-(aminoethyl)-3-aminopropyl triethoxysilane, 3-aminopropyl trimethoxysilane, 3-aminopropyl triethoxysilane, 3-triethoxysilyl-N-(1,3-dimethyl-butylidene)propylamine, N-phenyl-3-aminopropyl trimethoxysilane, N-(vinylbenzyl)-2-aminoethyl-3-aminopropyl trimethoxysilane, and various modified organosiloxanes containing functional groups such as an amino group at side chains. The modified organosiloxanes are commercially available from Shin-Etsu Chemical Co., etc. The polyvinylamine resin is not particularly limited, for example, commercially available polyvinylamine resins such as PVAM-0595B (trade name, manufactured by Mitsubishi Chemical Co.) are usable. The polyallylamine resin is not particularly limited, for example, commercially available polyallylamine resins such as PAA-01, PAA-10C, PAA-H-10C, and PAA-D-41HC1 (each trade name, manufactured by Nitto Boseki Co.) are usable. The polysiloxane may also be commercially available ones. Furthermore, two or more of a polyvinylamine resin, a polyallylamine resin, and a polysiloxane may be used together.

The ratio of the mass of the zirconium element and/or titanium element to the mass of the polyamine compound is preferably 0.1 to 100, more preferably 0.5 to 20. When the mass ratio is below 0.1, sufficient adhesion and corrosion resistance are unobtainable. When the mass ratio is above 100, cracks are likely to generate in the chemical conversion film and uniform films are difficult to obtain.

Blocked Isocyanate Compound

The blocked isocyanate compound is not particularly limited; examples thereof include tolylene diisocyanate isomers blocked by a phenol based, alcohol based, oxime based, active methylene based, acid amide based, carbamine based, subsulfate based blocking agent, or the like; aromatic diisocyanates such as 4,4'-diphenylmethane diisocyanate; aromatic-aliphatic diisocyanates such as xylylene diisocyanate; alicyclic diisocyanates such as isophorone diisocyanate and 4,4'-dicyclohexylmethane diisocyanate; and aliphatic diisocyanates such as hexamethylene diisocyanate and 2,2,4-trimethylhexamethylene diisocyanate.

Melamine Resin

Specific examples of the melamine resin as methylether type having a methoxy group are Cymel 303, Cymel 325, Cymel 327, Cymel 350, Cymel 370, and Cymel 385 (each trade name, manufactured by Mitsui Cyanamide Co.) and Sumimal M40S, Sumimal M50S, and Sumimal M100 (each trade name, manufactured by Sumitomo Chemical Co.). Specific examples as butylether type having a butoxy group are Uban 20SE60, Uban 20SE125 and Uban 20SE128 (each trade name, manufactured by Mitsui-Toats Chemical Co.), Super-Beckamine G821 and Super-Beckamine J820 (each trade name, manufactured by DIC Co.), and Mycoat 506 and Mycoat 508 (each trade name, manufactured by Mitsui Cyanamide Co.). Specific examples as mixed ether type are Cymel 325, Cymel 328, Cymel 254, Cymel 266, Cymel 267, Cymel 285, and Cymel 1141 (each trade name, manufactured by Mitsui Cyanamide Co.) and Nikalac MX-40 and Nikalac MX-45 (each trade name, manufactured by Mitsui Chemical Co.). It is preferable that the (A) silicon-containing compound is used as the adhesive imparting agent and the combination of the (A) silicon-containing compound and the (B) adhesive imparting metal ion is particularly preferable in view of performance. The preferable (A) silicon-containing compound is silane coupling agents, and hydrolysis-polycondensates of aminosilanes are particularly preferable. Furthermore, the (B) adhesive imparting metal ion, in combination with the (A) silicon-containing compound, is preferably aluminum ion and tin ion. That is, the combination of a silane coupling agent as the (A) silicon-containing compound and aluminum ion and/or tin ion as the (B) adhesive imparting metal ion is preferable as the adhesive imparting agent, and the combination of a hydrolysis-polycondensate of aminosilane as the (A) silicon-containing compound and the aluminum ion and/or tin ion as the (B) adhesive imparting metal ion is particularly preferable. Dramatically excellent film adhesion can be obtained by way that a film on the basis of aluminum and/or tin is formed even on the portions where the chemical conversion film on the basis of zirconium was not formed, by virtue of the existence of the aluminum ion and/or tin ion and also the existence of plural amino groups of hydrolysis-polycondensate of aminosilane at the film.

Oxidizing Agent

The metal surface treatment composition according to this embodiment may contain an oxidizing agent in order to promote formation of the chemical conversion film. The oxidizing agent, which the metal surface treatment composition can contain, may be at least one selected from the group consisting of nitric acid, nitrous acid, sulfuric acid, sulfurous acid, persulfate, phosphoric acid, hydrochloric acid, bromic acid, chloric acid, hydrogen peroxide, $HMnO_4$, $HVO_3$, $H_2WO_4$, $H_2MoO_4$, and salts thereof.

Stabilizing Agent

Preferably, the metal surface treatment composition according to this embodiment contains a stabilizing agent which inhibits elution of the components in the chemical conversion film during the cathodic electrodeposition coating. As described above, the film resistivity of the chemical conversion film which is obtained by treating with the zirconium and/or titanium based metal surface treatment composition, is lower than those of the conventional zinc phosphate based films. Besides, when the cathodic electrodeposition coating is applied on the metal base material on which a chemical conversion film containing zirconium and/or titanium has been formed, components in the chemical conversion film elute and act as an electrolyte under an alkaline condition near the metal base material acting as the negative electrode. The electrolyte tends to permeate into the electrodeposition coating film, therefore, the film resistance of the electrodeposition coating film decreases thereby remarkably degrading the uniformity of the electrodeposition coating material. The stabilizing agent inhibits the elution of the components of the chemical conversion film and also adsorbs to defective portions of the chemical conversion film (exposed portions of metal base material) thereby to enhance the corrosive resistivity of the film and to improve the corrosion resistance. Since the stabilizing agent further has a chelating force, for example, it stabilizes iron (II) ion and inhibits the generation of sludge such as that of iron oxide, consequently to bring about a merit to prolong the lifetime of treatment baths. In order to prevent the decrease of the film resistance of the electrodeposition coating film due to the electrolyte generation during the electrodeposition coating, the metal surface treatment composition according to this embodiment contains the stabilizing agent which can capture the eluted ions etc. to insolubilize or stabilize them. The stabilizing agent may be specifically at least one selected from the group consisting of a hydroxy acid, an amino acid, an aminocarboxylic acid, an aromatic acid, a polyvalent anion, a sulfonic acid compound, and a phosphonic acid compound. In addition, the stabilizing agent may be used to prepare the metal surface treatment composition which can improve the uniformity during the cathodic electrodeposition coating by way of adding the stabilizing agent to a conventional zirconium and/or titanium based metal surface treatment composition.

Hydroxy Acid

The hydroxy acid is a collective term of carboxylic acids having a hydroxyl group together with, and occasionally is also referred to as hydroxycarboxylic acid, oxy acid, alcohol acid, etc. In this embodiment, water-soluble compounds having at least one carboxylic group and at least one hydroxyl group per one molecule can be used. Specifically, ascorbic acid, citric acid, malonic acid, gluconic acid, tartaric acid, and lactic acid can be preferably used.

Amino Acid

In addition to various natural amino acids and synthetic amino acids, synthetic amino acids having at least one amino group and at least one acid group (carboxylic group, sulfonic group, etc.) per one molecule can be broadly used as the amino acid. Among these, at least one selected from the group consisting of alanine, glycine, glutamic acid, aspartic acid, histidine, phenylalanine, asparagine, arginine, glutamine, cysteine, leucine, lysine, proline, serine, tryptophan, valine, tyrosine, and salts thereof can be preferably used. Furthermore, when optical isomers exist in the amino acid, any isomers can be used regardless of L-form, D-from, or racemic form.

Aminocarboxylic Acid

Except for the amino acids described above, compounds having both functional groups of an amino group and a carboxylic group per one molecule can be broadly used as the aminocarboxylic acid. Among these, at least one selected from the group consisting of diethylene triamine pentaacetic acid (DTPA), hydroxyethyl ethylenediamine triacetic acid (HEDTA), triethylene tetraamine hexaacetic acid (TTHA), 1,3-propanediamine tetraacetic acid (PDTA), 1,3-diamino-6-hydroxypropane tetraacetic acid (DPTA-OH), hydroxyethyl iminodiacetic acid (HIDA), dihydroxy ethyl glycine (DHEG), glycol ether diamine tetraacetic acid (GEDTA), dicarboxymethyl glutamic acid (GEDTA), (S,S)-ethylenediamine succinic acid (EDDS), and salts thereof can be preferably used. In addition, ethylenediamine tetraacetic acid (EDTA) and nitrilotriacetic acid (NTA) are usable but finical in use from the viewpoint of toxicity and lower biodegradability. Also, sodium nitrilotriacetate, which is a sodium salt of NTA, is considered to be less problematic for the items described above and thus preferably usable.

Aromatic Acid

The aromatic acid is specifically exemplified by phenol compounds having at least one phenolic hydroxyl group per one molecule. The phenol compounds are exemplified by the compounds having two or more phenolic hydroxyl groups such as catechol, gallic acid, pyrogallol and tannin acid or phenol compounds having a basic skeleton of these compounds (for example, polyphenol compounds which contain flavonoid, tannin, catechin, etc, polyvinyl phenol, water-soluble resol, novolac resins, etc. . . . ), lignin, etc. Among these, tannin, gallic acid, catechin, and pyrogallol are particularly preferable. The flavonoid is not particularly limited; examples thereof include flavone, isoflavone, flavonol, flavanone, flavanol, anthocyanidin, orlon, chalkone, epigallocatechin gallate, galiocatechin, theaflavin, daidzin, genistin, rutin and myricitrin.

Phosphonic Acid Compound

Organic phosphonic acid compounds such as 1-hydroxy ethylidene-1,1-diphosphonic acid-2-phosphobutanone-1,2,4-tricarboxylic acid, ethylenediamine tetra(methylene phosphonic acid), diethylene triamine penta(methylene phosphonic acid), and 2-phosphobutanone-1,2,4-tricarboxylic acid are preferably used as the phosphonic acid compound. The phosphonic acid compounds may be used alone or in combination.

Sulfonic Acid Compound

At least one selected from the group consisting of meta sulfonic acid, isechi sulfonic acid, taurine, naphthalene disulfonic acid, aminonaphthalene disulfonic acid, sulfosalicylic acid, naphthalenesulfonic acid/formaldehyde condensate, alkylnaphthalene sulfonic acid, and salts thereof can be used as the sulfonic acid. The coating property and corrosion resistance of the metal base material after surface treatment can be improved by use of the sulfonic acid compound. The mechanism is not necessarily clear, but the following two reasons are considered. Firstly, substances of segregated silica, etc. exist on the surface of the metal base material of steel plate etc. and thus the surface composition is nonuniform, therefore, there exist portions where etching is difficult in the surface treatment. However, it is estimated that addition of the sulfonic acid compound can achieve the etching at the portions where the etching is difficult; consequently, a uniform chemical conversion film is likely to be formed on the surface of the material to be coated. That is, it is estimated that the sulfonic acid compound acts as an etching promoting agent. Secondly, it is believed that hydrogen gas, which can be generated by a chemical conversion reaction, may disturb an interfacial reaction during the surface treatment and the sulfonic acid compound removes the hydrogen gas by action of depolarization to promote the reaction. Among the sulfonic acid compounds, taurine is preferable in view of having both an amino group and a sulfonic group. The amount of the sulfonic acid compound is preferably 0.1 ppm to 10000 ppm, more preferably 1 ppm to 1000 ppm. When the amount is below 0.1 ppm, the effect to add the sulfonic acid compound is insufficient, and when the amount is above 10000 ppm, the deposition of the zirconium and/or titanium may be disturbed.

Polyvalent Anion

The polyvalent anion is not particularly limited; for example, at least one selected from the group consisting of phosphoric acid, a condensed phosphoric acid, a phosphonic acid, a lignin, tannins, a phenol compound, a polyacrylic acid, and sugars can be used. Among these, the tannins are exemplified by gallotannin, ellagitannin and catechin, and the sugars are exemplified by glucose, maltose and fructose. Among the polyvalent anions described above, a condensed phosphoric acid, a polyacrylic acid, and catechin are preferably used. In regards to the stabilizing agent, any of the hydroxy acid, amino acid, aminocarboxylic acid, aromatic acid, phosphonic acid compound, sulfonic acid compound, and polyvalent anion can improve the uniformity; preferably, one or at least two of the amino acid, aminocarboxylic acid, aromatic acid, phosphonic acid compound, sulfonic acid compound, and polyvalent anion is used since it is difficult to obtain the corrosion resistance when the hydroxy acid is used. Among these, one or two of the amino acid, aminocarboxylic acid, and sulfonic acid compound is preferably used as the stabilizing agent in view of the excellent effect to improve the uniformity and corrosion resistance when the (A) silicon-containing compound is used as the adhesive imparting agent, and the sulfonic acid compound is particularly preferable in view of particularly excellent effect to improve the uniformity and corrosion resistance.

Furthermore, when the (A) silicon-containing compound and the (B) adhesive imparting metal ion are used together with as the adhesive imparting agent, the uniformity and corrosion resistance can be improved in particular by use of one or at least two of the amino acid, aminocarboxylic acid, and sulfonic acid compound as the stabilizing agent. In regards to the combination of the adhesive imparting agent and the stabilizing agent, a preferable combination is the hydrolysis-polycondensate of aminosilane of the (A) silicon-containing compound, the aluminum ion and/or tin ion of the (B) adhesive imparting metal ion, as the adhesive imparting agent, and one or at least two of the amino acid, aminocarboxylic acid, and sulfonic acid compound, in particular the sulfonic acid compound as the stabilizing agent.

Amount of Stabilizing Agent

The amount of the stabilizing agent to add to the metal surface treatment composition according to this embodiment is within the range of 0.1 ppm to 10000 ppm, more preferably within the range of 1 ppm to 1000 ppm. The concentration below 0.1 ppm of the stabilizing agent is undesirable since the effect to add the stabilizing agent is not sufficiently obtainable, and the concentration above 10000 ppm is undesirable since the chemical conversion film may be disturbed to form.

Reductive Chelating Force of Stabilizing Agent

It is preferred that the stabilizing agent has a reductive chelating force. By virtue of this reducing ability, iron (II) ion, dissolved in surface treatment baths, can be inhibited to be oxidized into iron (III) ion thereby inhibiting the generation of sludge. Furthermore, the resulting iron (III) ion is stabilized by chelation. Consequently, the lifetime of surface treatment baths is prolonged. The stabilizing agent having the reductive chelating force is exemplified by lactic acid, ascorbic acid, citric acid, etc. These stabilizing agents may be used alone or in combination of two or more.

Fluorine Ion

The uniformity improving agent according to this embodiment may further contain a fluorine ion. The fluorine ion plays a role of an etching agent of the metal base material and a complexing agent of zirconium and/or titanium. The supply source of the fluorine ion is not particularly limited; examples thereof include fluorides such as hydrofluoric acid, ammonium fluoride, fluoroboric acid, ammonium hydrogen fluoride, sodium fluoride, and sodium hydrogen fluoride. Furthermore, complex fluorides may be the supply source, and are exemplified by hexafluorosilicates, specifically, hydrofluosilic acid, zinc hydrofluosilicate, manganese hydrofluosilicate, magnesium hydrofluosilicate, nickel hydrofluosilicate, iron hydrofluosilicate, calcium hydrofluosilicate, etc.

Guanidine Compound

The metal surface treatment composition according to this embodiment may contain a guanidine compound having a guanidine skeleton. The guanidine compound tends to coordinate to the metal element which constitutes the metal base material, thus can passivate the metal surface and provide the metal base material with the corrosion resistance. The guanidine compound is not particularly limited as long as having the guanidine skeleton in the molecule. Specific examples are guanidine, amino guanidine, guanyl thiourea, 1,3-diphenyl guanidine, 1,3-di-o-tolylguanidine, 1-o-tolylbiguanide, polyhexamethylene biguanidine, polyhexaethylene biguanidine, polypentamethylene biguanidine, polypentaethylene biguanidine, polyvinyl biguanidine, polyallyl biguanidine, chlorohexylzine, and salts thereof. The salt of the guanidine compounds described above is not particularly limited, and are exemplified by acetates, formates, lactates, nitrates, hydrochlorides, sulfates, phosphates, gluconates, etc.

Heating/Drying Step

The metal base material, subjected to the step of forming the chemical conversion film, is heated and dried at the heating/drying step. The soluble substances (metal oxides or ion components), which elute during cathodic electrodeposition to cause degradation of the uniformity of electrodeposition coating film due to lowering the electric resistivity of the electrodeposition coating film, stabilize in the chemical conversion film as a result of heating the chemical conversion film, therefore, the elution of these compounds is prevented. Accordingly, the resistance value of the chemical conversion film does not decrease and the uniformity does not degrade.

The heating temperature is 60° C. to 190° C. at the heating/drying step, preferably 80° C. to 160° C. A heating temperature below 60° C. is undesirable since insoluble compounds are not sufficiently formed during the electrodeposition coating. Furthermore, a heating temperature above 190° C. is disadvantageous in view of the cost since further performance improvement cannot be expected. The heating time is 30 seconds to 180 minutes, preferably 60 seconds to 60 minutes. A heating time below 30 seconds is undesirable since insoluble compounds are not sufficiently formed during the electrodeposition coating. Furthermore, a heating time above 180 minutes is disadvantageous in view of the cost since further performance improvement cannot be expected.

Metal Base Material

The metal base material, used in the surface treatment method according to this embodiment, is not particularly limited, and exemplified by an iron-based metal base material, an aluminum-based metal base material, and a zinc-based metal base material. Furthermore, the surface treatment method according to this embodiment can be applied to a combination of plural kinds of metal base materials (including connecting or contacting portions between different kinds of metals) of the iron-based metal base material, aluminum-based metal base material, zinc-based metal base material, etc. The car bodies, parts for cars, etc. are constructed from various metal base materials such as of iron, zinc, aluminum, etc.; a chemical conversion film can be formed with sufficient coverage and adhesion to the base material, and appropriate corrosion resistance can be provided thereto in accordance with the surface treatment method of this embodiment. The iron-based metal base material used for the metal base material according to this embodiment is not particularly limited and exemplified by cold-rolled steel plate, hot-rolled steel plate, mild steel plate, high-tension steel plate, etc. Furthermore, the aluminum-based metal base material is not particularly limited and exemplified by 5000 series aluminum alloys, 6000 series aluminum alloys, and aluminum-plated steel plate such as of aluminum based electro-plating, hot-dip plating, vapor-deposition plating, etc. Furthermore, the zinc-based metal base material is not particularly limited and exemplified by zinc plated or zinc-based alloy plated steel plate of electro-plating, hot-dip plating, or vapor-deposition plating steel plate such as galvanized steel plate, zinc-nickel plated steel plate, zinc-titanium plated steel plate, zinc-magnesium plated steel plate, zinc-manganese plated steel plate, etc. The high-tension steel plate, which encompasses a wide variety of grades depending on strength or production methods, is exemplified by JSC400J, JSC440P, JSC440W, JSC590R, JSC590T, JSC590Y, JSC780T, JSC780Y, JSC980Y, JSC1180Y, etc.

Amount of Chemical Conversion Film

The film amount of the chemical conversion film in the case of the iron-based metal base material, formed by the surface treatment method according to this embodiment, is preferably at least 10 g/m$^2$ based on a metal element content of zirconium and/or titanium, more preferably at least 20 g/m$^2$, and most preferably at least 30 g/m$^2$. When the film amount of the chemical conversion film is below 10 g/m$^2$, sufficient corrosion resistance is unobtainable. Although there is particularly no upper limit as for the film amount of the chemical conversion film concerning any metal materials, excessively large film amounts tend to generate cracks in the chemical conversion film and makes difficult to obtain a uniform film. In this regard, the film amount of the chemical conversion film, formed by the surface treatment method according to this embodiment, is preferably no larger than 1 g/m$^2$ based on metal element content of zirconium and/or titanium, more preferably no larger than 800 mg/m$^2$.

Metal Material

In the metal material having on the metal base material the chemical conversion film formed by the surface treatment method according to this embodiment, the soluble substances (metal oxides or ion components), which elute during cathodic electrodeposition to cause degradation, of the uniformity of electrodeposition coating film due to lowering the electric resistivity of the electrodeposition coating film, are stabilized in the chemical conversion film. For this reason, when the cathodic electrodeposition coating is conducted using the metal material of this embodiment, the coating film can be uniformly formed and thus the uniformity can be improved since the film resistivity of the chemical conversion film does not decrease.

Cathodic Electrodeposition Coating

Electrodeposition Coating Step

In the electrodeposition coating step, the cathodic electrodeposition coating is conducted by applying typically a voltage of 50 V to 450 V between a negative electrode of a material to be coated and a positive electrode. When the applied voltage is below 50 V, the electrodeposition is insufficient, and when above 450 V, the coating film is destroyed to result in an abnormal appearance. It is also preferred that the time to apply the voltage, which depends on the electrodeposition conditions, is 2 minutes to 4 minutes in general. Following completing the electrodeposition step, the coating film, obtained in this way, is baked (heat treatment) and cured directly or after water washing. The baking condition is preferably 120° C. to 260° C., more preferably 140° C. to 220° C. When the temperature is below 120° C., sufficient effect cannot be obtained from the baking, and when the temperature is above 260° C., sufficient performance cannot be exerted due to decomposition of resins, etc. Preferably, the baking time is 10 minutes to 120 minutes.

Cathodic Electrodeposition Coating Material

The cathodic electrodeposition coating material, usable in the cathodic electrodeposition coating, may be conventional ones without particular limitation; and conventional cathodic electrodeposition coating materials can be used that contain modified epoxy resins such as aminated epoxy resins, aminated acrylic resins and sulfoniumated epoxy resins; curing agents, and sealing agents. The modified epoxy resin according to this embodiment is not particularly limited and may be used from conventional ones. Preferably, amine-modified epoxy resins, which are prepared by opening an epoxy ring of a bisphenol-type epoxy resin by an amine, and oxazolidone ring-containing epoxy resins are used. A typical example of bisphenol-type epoxy resin, for a raw material of the modified epoxy resins, is a bisphenol A-type or bisphenol F-type epoxy resin. Commercialized products of the former are Epicoat 828 (trade name, manufactured by Yuka-Shell Epoxy Co., epoxy equivalent: 180 to 190), Epicoat 1001 (trade name, manufactured by Yuka-Shell Epoxy Co., epoxy equivalent: 450 to 500), Epicoat 1010 (trade name, manufactured by Yuka-Shell Epoxy Co., epoxy equivalent: 3000 to 4000), etc., and commercialized products of the latter are Epicoat 807 (trade name, manufactured by Yuka-Shell Epoxy Co., epoxy equivalent: 170) etc. The curing agent is not particularly limited and may be used from conventional ones. Preferably, a blocked isocyanate curing agent is used that is prepared by blocking a polyisocyanate with a sealing agent. Examples of the polyisocyanate include aliphatic diisocyanates such as hexamethylene diisocyanate, hexamethylene diisocyanate, tetramethylene diisocyanate and trimethylhexamethylene diisocyanate; cycloaliphatic polyisocyanates such as isophorone diisocyanate and 4,4'-methylene bis(cyclohexylisocyanate); and aromatic diisocyanates such as 4,4'-diphenylmethane diisocyanate, tolylene diisocyanate and xylylene diisocyanate. Examples of the sealing agent include monovalent alkyl (or aromatic) alcohols such as n-butanol, n-hexyl alcohol, 2-ethyl hexanol, lauryl alcohol, phenol carbinol and methyl phenyl carbinol; cellosolves such as ethylene glycol monohexyl ether and ethylene glycol mono-2-ethylhexyl ether; phenols such as phenol, parat-butylphenol and cresol; oximes such as dimethyl ketoxime, methyl ethyl ketoxime, methyl isobutyl ketoxime, methyl amyl ketoxime and cyclohexane oxime; and lactams typified by ϵ-caprolactam and γ-butyrolactam.

Second Embodiment

Second embodiment of the present invention is explained in detail. In addition, the explanations in this embodiment are omitted in regards to the same constituent parts as those of the first embodiment.

Surface Treatment Method

In this embodiment, the surface treatment method of treating the surface of the metal base material consists of a step of surface treatment in which the metal surface treatment composition, containing zirconium and/or titanium ions and an adhesive imparting agent, comes into contact with the metal base material to form a chemical conversion film and a step of hot water treatment in which the metal base material, on which the chemical conversion film has been formed, comes into contact with hot water at a certain temperature.

Step of Hot Water Treatment

In the step of hot water treatment, the metal base material, on which the chemical conversion film has been formed, comes into contact with hot water under a certain condition. This leads to stabilize the soluble substances (metal oxides or ion components), which elute during cathodic electrodeposition to cause degradation of the uniformity of electrodeposition coating film due to lowering the electric resistivity of the electrodeposition coating film, in the chemical conversion film, thus the elution of these compounds is disturbed. Accordingly, the resistance value of the chemical conversion film does not decrease and the uniformity does not degrade. In the step of hot water treatment, the metal base material is treated to contact with hot water under atmospheric pressure or pressurized conditions at 60° C. to 120° C. for 2 seconds to 600 seconds. A temperature below 60° C. of the hot water is undesirable since the insoluble compounds are not sufficiently formed during the electrodeposition coating and the effect of the present invention is not sufficiently obtained. A temperature above 120° C. of the hot water is not particularly effective and is no more than economically disadvantageous. More preferably, the temperature of the hot water is 65° C. to 90° C. As described above, the treatment time at the step of hot water treatment is 2 seconds to 600 seconds. A treatment time below 2 seconds is undesirable since the insoluble compounds are not sufficiently formed during the electrodeposition coating and the effect of the present invention is not sufficiently obtained. A treatment time above 600° C. is not particularly effective and is no more than economically disadvantageous. More preferably, the treatment time is 10 seconds to 180 seconds.

Third Embodiment

Third embodiment of the present invention is explained in detail. In addition, the explanations in this embodiment are omitted in regards to the same constituent parts as those of the first embodiment.

Surface Treatment Method

In this embodiment, the surface treatment method of treating the surface of the metal base material consists of a step of surface treatment in which the metal surface treatment composition, containing zirconium and/or titanium ions and an adhesive imparting agent, comes into contact with the metal base material under a certain condition to form a chemical conversion film.

Step of Surface Treatment

In the step of surface treatment according to this embodiment, the metal surface treatment composition, containing zirconium and/or titanium ions and an adhesive imparting agent, comes into contact with the metal base material to form a chemical conversion film. The chemical conversion film can be formed by making the surface treatment liquid containing the metal surface treatment composition contact with the metal base material; the method to make the surface treatment liquid containing the metal surface treatment composition contact with the metal base material is preferably a dipping method or a spray method. The treatment temperature at the step of surface treatment is within the range of 60° C. to 120° C. Sufficient effect is unobtainable at a temperature below 60° C., and a temperature above 120° C. is not particularly effective and is no more than economically disadvantageous. Preferably, the treatment temperature is within the range of 65° C. to 90° C. The treatment time at the step of surface treatment is 2 seconds to 600 seconds. A time below 2 seconds is inadequate since a sufficient amount of the film is unobtainable and a time above 600 seconds may result in cracks in the film. Preferably, the treatment time is 20 seconds to 180 seconds. The soluble substances (metal oxides or ion components), which elute during cathodic electrodeposition to cause degradation of the uniformity of electrodeposition coating film due to lowering the electric resistivity of the electrodeposition coating film, are unlikely to be formed in the chemical conversion film by surface-treating under the condition, described, above. Accordingly, the resistance value of the chemical conversion film does not decrease and the uniformity does not degrade.

Fourth Embodiment

Fourth embodiment of the present invention is explained in detail. In addition, the explanations in this embodiment are omitted in regards to the same constituent parts as those of the first embodiment.

Surface Treatment Method

In this embodiment, the surface treatment method of treating the surface of the metal base material consists of a step of surface treatment in which the metal surface treatment composition, containing zirconium and/or titanium ions and an adhesive imparting agent, comes into contact with the metal base material to form a chemical conversion film while applying a cathode electrolytic treatment.

Step of Surface Treatment

In the step of surface treatment according to this embodiment, the metal surface treatment composition, containing zirconium and/or titanium ions and an adhesive imparting agent, comes into contact with the metal base material to form a chemical conversion film while applying a cathode electrolytic treatment. The method to make the metal surface treatment composition contact with the metal base material is preferably a dipping method. The treatment temperature at the step of surface treatment is preferably within the range of 20° C. to 70° C., more preferably 30° C. to 50° C. The temperature below 20° C. may result in insufficient formation of the film and be undesirable in that coolers etc. are necessary to control the temperature during the summer season, and a temperature above 70° C. is not particularly effective and is no more than economically disadvantageous.

The treatment time in the step of surface treatment is preferably 2 seconds to 1100 seconds, more preferably 30 seconds to 120 seconds. A treatment time below 2 seconds is undesirable in that the film is unobtainable in a sufficient amount and a treatment time above 1100 seconds is not desirable since no additional effect is obtainable with an increase in the amount of film. In the step of surface treatment according to this embodiment, the surface treatment is conducted while applying a cathode electrolytic treatment thereby to form the chemical conversion film. As a result, the soluble substances (metal oxides or ion components), which elute during cathodic electrodeposition to cause degradation of the uniformity of electrodeposition coating film due to lowering the electric resistivity of the electrodeposition coating film, are unlikely to be formed in the chemical conversion film. Accordingly, the resistance value of the chemical conversion film does not decrease and the uniformity does not degrade. The applied voltage is 0.1 V to 40 V during the cathode electrolytic treatment. A applied voltage below 0.1 V results in an insufficient effect. Furthermore, an applied voltage above 40 V is not particularly effective and is no more than economically disadvantageous. The applied current density is 0.1 A/dm$^2$ to 30 A/dm$^2$ during the cathode electrolytic treatment. An applied current density below 0.1 A/dm$^2$ results in an insufficient effect. Furthermore, an applied current density above 30 A/dm$^2$ is not particularly effective and is no more than economically disadvantageous.

EXAMPLES

Example 1

Metal Base Material

A commercially available cold-rolled steel (SPC, manufactured by Nippon Testpanel Co., 70 mm by 150 mm by 0.8 mm) was prepared for a metal base material.

Pretreatment of Metal Base Material

Surf Cleaner EC92 (trade name, manufactured by Nippon Paint Co.) was used for an alkali degreasing treatment agent to degrease the metal material at 40° C. for 2 minutes. The material was dipped and cleaned in a water-washing bath and then spray-washed with tap water for about 30 seconds.

Preparation of Metal Surface Treatment Composition

A metal surface treatment composition was obtained by way of adding 40% zirconic acid as 500 ppm of zirconium based on metal element content and KBE 903 (3-aminopropyl-triethoxysilane, effective concentration: 100%, trade name, manufactured by Shin-Etsu Chemical Co.) as an adhesive imparting agent in an effective component amount of 200 ppm and adjusting to pH 4 by NaOH. In addition, a hydrolysis-polycondensate of KBE 903 with an effective component of 5% (hereinafter referred to as "KBE 903 polycondensate A") was used as the KBE 903 described above that was prepared by way of dropping 5 mass parts of KBE 903 from a dripping funnel into a mixed solvent (solvent temperature: 25° C.) of 45 mass parts of deionized water and 50 mass parts of ethanol constantly over 60 minutes, allowing the mixture to react at 25° C. for 24 hours under a nitrogen atmosphere, and then depressurizing the reactant solution to evaporate the ethanol.

Using the metal surface treatment composition, the surface treatment was conducted at 40° C. for 90 seconds. The ratio of the amount of zirconium element to the total amount of silicon element contained in the aminosilane and/or hydrolysis-polycondensate of aminosilane (Zr/Si ratio) was 20.

Heating/Drying Step

The surface-treated metal base material was heated and dried at 90° C. for 5 minutes.

Example 2

The metal base material was surface-treated in the same manner as described in Example 1, except that KBM 603 (N-2-(aminoethyl)-3-aminopropyl-trimethoxysilane, trade name, manufactured by Shin-Etsu Chemical Co.) and a colloidal silica of Snowtex 0 (trade name, manufactured by Nissan Chemical Industries, Ltd.) were used respectively in an effective component concentration of 200 ppm as an adhesive imparting agent, and zirconium was used in an amount of 250 ppm based on metal element content. The Zr/Si ratio was 10. The material was heated and dried at 90° C. for 120 minutes. In addition, in regards to the KBM 603 described above, a hydrolysis-polycondensate of KBM 603 (hereinafter referred to as "KBM 603 polycondensate") was used that was previously polycondensed in the same manner as Example 1 except that the KBM 603 was used in place of the KBE 903.

Example 3

The metal base material was surface-treated in the same manner as described in Example 1, except that the metal surface treatment composition was prepared by way of using 50 ppm of PAA-H-10C (polyallylamine resin, trade name, manufactured by Nitto Boseki Co.) and 500 ppm of zinc nitrate as an adhesive imparting agent, using zirconium in an amount of 700 ppm based on metal element content, and adjusting the pH to 3.5. The material was heated and dried at 80° C. for 5 minutes.

Example 4

An organosilane hydrolysis-polycondensate in an effective component of 30% (hereinafter referred to as "KBE 903/KBE 603 co-condensate") was obtained by way of dropping 15 mass parts of KBE 903 (trade name, manufactured by Shin-Etsu Chemical Co.) and 15 mass parts of KBE 603 (N-2-(aminoethyl)-3-aminopropyl-trimethoxysilane, trade name, manufactured by Shin-Etsu Chemical Co.) from a dripping funnel into 70 mass parts of deionized water as a solvent (solvent temperature: 25° C.) constantly over 60 minutes and then allowing to react the mixture at 25° C. for 24 hours under a nitrogen atmosphere. The metal base material was surface-treated in accordance with the method described in Example 1, except for using the KBE 903/KBE 603 co-condensate in an effective component concentration of 300 ppm as an adhesive imparting agent and using zirconium in an amount of 700 ppm based on metal element content. The Zr/Si ratio was 19. The material v/as heated and dried at 120° C. for 5 minutes.

Example 5

The metal base material was surface-treated in the same manner as described in Example 1, except that KBE 603 (trade name, manufactured by Shin-Etsu Chemical Co.) in an effective component concentration of 300 ppm and hydrofluorosilicic acid in an effective component concentration of 50 ppm were used as an adhesive imparting agent. The Zr/Si ratio was 13. The material was heated and dried at 150° C. for 5 minutes. In addition, in regards to the KBE 603 described above, a hydrolysis-polycondensate of KBE 603 (hereinafter referred to as "KBE 603 polycondensate") was used that was previously polycondensed in the same manner as Example 1 except the KBE 603 was used in place of the KBE 903.

Example 6

The metal base material was surface-treated in the same manner as described in Example 1, except that PAA-H-10C (trade name, polyallylamine resin, manufactured by Nitto Boseki Co.) was used in an amount of 30 ppm as an adhesive imparting agent, HIDA (hydroxyethyl iminodiacetic acid) was used in an amount of 200 ppm as a uniformity improving agent, and zirconium was used in an amount of 250 ppm based on metal element content. The material was heated and dried under the same condition described in Example 1.

Example 7

The metal base material was surface-treated in the same manner as described in Example 1, except that KBE 903 polycondensate A was used in an effective component concentration of 150 ppm as an adhesive imparting agent, aspartic acid was used in an amount of 100 ppm as a uniformity improving agent, and zirconium was used in an amount of 250 ppm based on metal element content. The Zr/Si ratio was 13. The material was heated and dried under the same condition described in Example 1.

Example 8

Thirty mass parts of KBE 903 (trade name, manufactured by Shin-Etsu Chemical Co.) was dropped from a dripping funnel into a mixture solvent (solvent temperature: 25° C.) of 35 mass parts of deionized water and 35 mass parts of isopropyl alcohol constantly over 60 minutes. The mixture was allowed to react at 25° C. for 24 hours under a nitrogen atmosphere. Thereafter the reactant solution was depressurized to evaporate the isopropyl alcohol thereby to obtain an organosilane hydrolysis-polycondensate (hereinafter referred to as "KBE 903 polycondensate B") in an effective component of 30%. The metal base material was surface-treated in the same manner as described in Example 1, except that this KBE 903 polycondensate B was used in an effective component concentration of 150 ppm as an adhesive imparting agent and citric acid was used in an amount of 50 ppm as a uniformity improving agent. The Zr/Si ratio was 43. The material was heated and dried under the same condition described in Example 1.

Example 9

The metal base material was surface-treated in the same manner as described in Example 1, except that Colloidal Silica OXS (trade name, manufactured by Nissan Chemical Industries, Ltd.) was used in an effective component concentration of 200 ppm as an adhesive imparting agent. The material was heated and dried under the same condition described, in Example 1.

Example 10

The metal base material was surface-treated in the same manner as described in Example 1, except that KBE 903 polycondensate A in an effective component concentration of 200 ppm and magnesium nitrate in an amount of 500 ppm were used as an adhesive imparting agent and zirconium was used in an amount of 250 ppm based on metal element content. The material was heated and dried under the same condition described in Example 1.

Example 11

The metal base material was surface-treated in the same manner as described in Example 1, except that fluorozirconic acid was used as zirconium in an amount of 250 ppm based on metal element content, a modified polyallylamine was used in an amount of 50 ppm as an adhesive imparting agent, sodium nitrite was used in an amount of 100 ppm as an additive, and the pH was adjusted to 3.5. The material was heated and dried under the same condition described in Example 1. Here, the modified polyallylamine was synthesized by way that 1 weight % of PAA 10C (polyallylamine, effective concentration: 10%, trade name, manufactured by Nitto Boseki Co.) and KBM 403 (3-glycidoxypropyl-trimethoxysilane, effective concentration: 100%, trade name, manufactured by Shin-Etsu Chemical Co.) were mixed in an weight ratio of 1:0.5 and allowed to react at a reaction temperature of 25° C. for a reaction time of 60 minutes.

Example 12

The metal base material was surface-treated in the same manner as described in Example 1, except that KBE 903 polycondensate A was used in an effective component concentration of 200 ppm as an adhesive imparting agent, polypentamethylene biguanidine acetate (biguanide) was used in an amount of 100 ppm as an additive, and zirconium was used in an amount of 700 ppm based on metal element content. The Zr/Si ratio was 28. The material was heated and dried under the same condition described in Example 1.

Example 13

The metal base material was surface-treated in the same manner as described in Example 1, except that KBE 903 polycondensate B was used in an effective component concentration of 150 ppm as an adhesive imparting agent and ascorbic acid was used in an amount of 100 ppm as an additive. The Zr/Si ratio was 27. The material was heated and dried under the same condition described in Example 1.

Example 14

The metal base material was surface-treated in the same manner as described in Example 1, except that KBE 903 (trade name, manufactured by Shin-Etsu Chemical Co.) was used in an effective component amount of 100 ppm as an adhesive imparting agent, the pH was adjusted to 5, and the surface treatment was conducted at 80° C. for 60 seconds. The Zr/Si ratio was 27. Heating and drying were not conducted.

Example 15

A metal base material similar to that of Example 1 was used and pretreatment was applied to the metal base material similarly as Example 1.

Preparation of Metal Surface Treatment Composition

40% zirconic acid as 500 ppm of zirconium based on metal element content and KBE 903 polycondensate B as an adhesive imparting agent in an effective component concentration of 150 ppm were added and pH was adjusted to 3.5 by NaOH. Using the metal surface treatment composition, the surface treatment was conducted at 30° C. for 90 seconds while applying a cathode electrolytic treatment at an applied voltage of 10 V. The Zr/Si ratio was 27.

Example 16

A metal base material similar to that of Example 1 was used and pretreatment was applied to the metal base material similarly as Example 1.

Preparation of Metal Surface Treatment Composition

40% zirconic acid as 500 ppm of zirconium based on metal element content, KBE 903 polycondensate A as an adhesive imparting agent in an effective component concentration of 300 ppm, and hydrofluorosilicic acid in an effective component concentration of 50 ppm were added and the pH was adjusted to 4 by NaOH. Using the metal surface treatment composition, the surface treatment was conducted at 40° C. for 90 seconds. The Zr/Si ratio was 27.

Step of Hot Water Treatment

The surface-treated metal base material was hot water-treated at 80° C. for 1 minute.

Comparative Example 1

The metal base material was surface-treated in accordance with the method described in Example 1. The Zr/Si ratio was 20. Heating and drying were not conducted.

Comparative Example 2

The metal base material was surface-treated in accordance with the method described in Example 1 except that no adhesive imparting agent was used. Heating and drying were not conducted.

Comparative Example 3

The metal base material was surface-treated in the same manner as described in Example 1, except that no adhesive imparting agent was used, 100 ppm of sodium nitrite was used as an additive, and zirconium was used in a concentration of 250 ppm based on metal element content. Heating and drying were not conducted.

Comparative Example 4

The metal base material was surface-treated in the same manner as described in Example 1, except that PAA-10C (polyallylamine resin, trade name, manufactured by Nitto Boseki Co.) was used in an amount of 50 ppm as an adhesive imparting agent, and magnesium nitrate was used in an amount of 100 ppm. Heating and drying were not conducted.

Comparative Example 5

The metal base material was surface-treated in the same manner as described in Example 1, except that HIDA was used in an amount of 200 ppm as a uniformity improving agent and no adhesive imparting agent was used. Heating and drying were not conducted.

Comparative Example 6

Reference Example

Surface treatment was conducted using a zinc phosphate based surface treatment agent of Surffine GL1/Surfdine 6350 (trade name, manufactured by Nippon Paint Co.) as a surface treatment agent. Pretreatment prior to the surface treatment was conducted in accordance with the method described in Example 1. Heating and drying were not conducted.

Evaluation Method

Uniformity

The uniformity was evaluated in accordance with the "four-plate box method" described in Japanese Unexamined Patent Application, First Publication No. Hei 2000-0.038525, That is, as shown in FIG. 1, the surface-treated metal materials of Examples 1 to 16 and Comparative Examples 1 to 6 were disposed such that four plates stood in parallel with a distance of 20 mm and lower portions of both sides and bottom faces were sealed with an insulating material such as fabric adhesive tape to prepare a box 10. In addition, through holes 5 of diameter 8 mm were provided at lower portions of the metal materials 1, 2 and 3 except for the metal material 4.

The box 10 was dipped into an electrodeposition coating container 20 filled with a cathodic electrodeposition coating material. In this case, the cathodic electrodeposition coating material flows into the box 10 only from each through hole 5. While stirring the cathodic electrodeposition coating material with a magnetic stirrer, the metal materials 1 to 4 were electrically connected and a counter electrode 21 was disposed at a distance of 150 mm from the metal material 1. A voltage was applied to the metal materials 1 to 4 as a negative electrode and the counter electrode 21 as a positive electrode to conduct a cathodic electrodeposition coating. The coating was conducted in a way such that the voltage was increased for 5 seconds so as to form a coating film having a thickness of 20 μm on the A face of the metal material 1, followed by maintaining the voltage for 175 seconds. The bath temperature was adjusted to 30° C. at this time. The coated metal materials 1 to 4 were water-washed and then baked at 170° C. for 25 minutes followed by air-cooling, thereafter, the film thickness of the coating film formed on the A face of the metal material 1 proximal to the counter electrode 21 and the film thickness of the coating film formed on the G face of the metal material 4 farthest from the counter electrode 21 were measured and the uniformity was evaluated on the basis of the ratio of film thickness (G face)/film thickness (A face). The larger the value, the uniformity can be evaluated to be more excellent. The results are shown in Table 1.

Appearance of Coating Film

Appearance of coated plates of metal materials after coating was observed and the appearance of coating film was evaluated in accordance with the evaluation criteria below. The results are shown in Table 1.

A: uniform

B: somewhat nonuniform

C: nonuniform Observation of Sludge

Chemical conversion treatment was conducted in Examples and Comparative Examples, and turbidity (generation of sludge) in the chemical conversion treatment agents was visually compared after 30 days under room temperature to evaluate workability in accordance with the evaluation criteria below. The results are shown in Table 1.

A: transparent liquid

B: slightly dilute turbidity

C: turbidity

D: generation of deposit (sludge) Film Amount

The test plates obtained in Examples and Comparative Examples were measured with respect to the amounts of Zr and Si in the chemical conversion films. Measurement was carried out by fluorescent X-ray analysis. The results are shown in Table 1.

Secondary Adhesive Test (SDT)

The test plates obtained in Examples and Comparative Examples were each provided with longitudinally parallel two cuts up to the base material and immersed into an aqueous solution of 5% NaCl at 50° C. for 480 hours. Thereafter water-washing and air-drying were conducted, then an adhesive tape of Ellpack LP-24 (trade name, manufactured by Nichiban Co.) was adhered to the cut portions and then the adhesive tape was rapidly peeled. The size of the largest width (one side) was measured for the coating material adhered to the peeled adhesive tape. A similar test was conducted for galvanized steel plates (GA) and aluminum plates (Al) which were surface-treated and electrodeposition-coated. The results are shown in Table 1 (unit: mm).

Cyclic Corrosion Test (CCT)

The test plates obtained in Examples and Comparative Examples were each tape-sealed at the edge and back face and introduced a cross-cut flaw (flaw up to metal) and then a CCT test was conducted under the conditions below. That is, an aqueous solution of 5% NaCl maintained at 35° C. was continuously sprayed for 2 hours within a salt spray tester maintained at 35° C. and humidity 95%. Then the samples were dried for 4 hours under a humidity of 20% to 30% at 60° C. The swelled width (both sides) of coating film was measured after 200 cycles, in which one cycle corresponds to 3 times of the repeated procedures described above within 24 hours. A similar test was conducted for galvanized steel plates (GA) and high-tensile steel plates (HT) which had been surface-treated and electrodeposition-coated. The results are shown in Table 1 (unit: mm).

TABLE 1

| | | Uniformity | Appearance of Coating | | Film Amount | | SDT(mm) | | | CCT(mm) | | |
|---|---|---|---|---|---|---|---|---|---|---|---|---|
| | | (%) | Film | Sludge | Zr | Si | SPC | GA | AI | SPC | HT | GA |
| Example | 1 | 44% | A | B | 52 | 2.7 | 0 | 0 | 0 | 6 | — | — |
| | 2 | 46% | A | B | 51 | 2.8 | 0 | 0 | 0 | 6.2 | — | — |
| | 3 | 47% | A | B | 55 | — | 0 | 0 | 0 | 6 | — | — |
| | 4 | 44% | A | B | 44 | 4.3 | 0 | 0 | 0 | 6 | 7.5 | 4.8 |
| | 5 | 47% | A | B | 42 | 3.5 | 0 | 0 | 0 | 5.8 | — | — |
| | 6 | 48% | A | A | 51 | — | 0 | 0 | 0 | 5.8 | 7.7 | 5 |
| | 7 | 44% | A | A | 56 | 2.8 | 0 | 0 | 0 | 5.9 | 7 | 4.9 |
| | 8 | 45% | A | A | 54 | 7.2 | 0 | 0 | 0 | 6.2 | 6.8 | 4.8 |
| | 9 | 48% | A | B | 43 | — | 1 | 0 | 0 | 6 | — | — |
| | 10 | 44% | A | B | 44 | 2.6 | 0 | 0 | 0 | 6.1 | — | — |
| | 11 | 48% | A | B | 55 | — | 0.4 | 0 | 0 | 5.8 | — | — |
| | 12 | 50% | A | B | 52 | 2.6 | 0 | 0 | 0 | 6 | 7.5 | 5 |
| | 13 | 48% | A | B | 55 | 7 | 0 | 0 | 0 | 6.2 | 7.2 | 5 |
| | 14 | 41% | A | B | 48 | 7 | 0 | 0 | 0 | 6 | 7 | 5 |
| | 15 | 48% | A | B | 72 | 7 | 0 | 0 | 0 | 6.2 | 7 | 4.8 |
| | 16 | 41% | A | B | 55 | 7 | 0 | 0 | 0 | 6 | 7.2 | 5 |
| Comparative Example | 1 | 13% | B | B | 52 | 2.7 | 0.2 | 0 | 0 | 6.4 | 13.2 | 5 |
| | 2 | 12% | B | B | 59 | — | 7.6 | 1.2 | 0 | 10.1 | 16.8 | 5.5 |
| | 3 | 13% | B | B | 62 | — | 5.9 | 0.8 | 0 | 12.0 | 15.2 | 6 |
| | 4 | 14% | B | B | 63 | — | 4.5 | 1 | 0 | 10.2 | 17 | 5.5 |
| | 5 | 38% | C | A | — | — | 10 | 3 | 0 | 20.0 | 20 | 8.5 |
| | 6 | 42% | A | D | — | — | 2.1 | 1.2 | 0 | 11.5 | 8.9 | 5 |

The invention claimed is:

1. A surface treatment method comprising:

contacting a metal base material with a metal surface treatment composition to form a chemical conversion film on the metal base material, the metal surface treatment composition comprising:

(a) at least one of zirconium ions or titanium ions; and (b) at least one adhesive imparting agent selected from the group consisting of (i) a silicon-containing compound which is at least one of a silane coupling agent that is an aminosilane or hydrolysis-polycondensate of the aminosilane, having at least one amino group, (ii) an adhesive imparting metal ion selected from the group consisting of magnesium, zinc, calcium, aluminum, gallium, indium, copper, iron, manganese, nickel, cobalt, silver, and tin, and (iii) an adhesive imparting resin that is a polyamine compound; and contacting the metal base material on which the chemical conversion film has been formed with water under atmospheric pressure or pressurized conditions at 60° C. to 120° C. for 2 seconds to 600 seconds; and applying a cathodic electrodeposition coating film onto fine portions of the metal base material with curves and bag portions, wherein the total amount of the zirconium and titanium ions in the metal surface treatment composition is 10 ppm to 10000 ppm based on metal element content, wherein the total amount of the aminosilane, the hydrolysis-polycondensate of the aminosilane, or both, in the metal surface treatment compositions ranges from 1 ppm to 2000 ppm based on silicon element content, and the ratio of the total amount of zirconium and titanium elements to the total amount of silicon element contained in the aminosilane, the hydrolysis-polycondensate of the aminosilane, or both, is 0.5 to 500, and wherein the adhesive imparting metal ion is present in an amount of from 1 ppm to 5000 ppm in the metal surface treatment composition.

2. The surface treatment method according to claim 1, wherein the (A) silicon-containing compound is at least one selected from the group consisting of silica, silicofluoride, a soluble silicate compound, silicate esters, alkyl silicates, and a silane coupling agent.

3. The surface treatment method according to claim 1, wherein the adhesive imparting metal ion is tin.

4. The surface treatment method according to claim 1, wherein the metal surface treatment composition has a pH of 1.5 to 6.5.

5. The surface treatment method according to claim 1, wherein the metal surface treatment composition further comprises at least one oxidizing agent selected from the group consisting of nitric acid, nitrous acid, sulfuric acid, sulfurous acid, persulfate, phosphoric acid, hydrochloric acid, bromic acid, chloric acid, hydrogen peroxide, $HMnO_4$, $HVO_3$, $H_2WO_4$ $H_2MoO_4$, and respective salt of each thereof.

6. The surface treatment method according to claim 5, wherein the metal surface treatment composition further comprises at least one kind of stabilizing agent selected from the group consisting of an amino acid, an aminocarboxylic acid, an aromatic acid, a sulfonic acid compound, and a polyvalent anion.

7. The surface treatment method according to claim 1 wherein the at least one adhesive imparting resin comprises a polyamine compound having at least one constituent unit represented by the chemical formula:

(3)

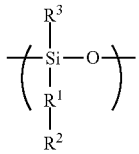

wherein the ratio of the total amount of the zirconium and/or titanium ions to the mass of the polyamine compound is 0.1 to 100, and wherein in the chemical formula (3), $R^1$ is an alkylene group having 1 to 6 carbon atoms, $R^2$ is a substituent group represented by the following chemical formulas (4) to (6) shown below, and $R^3$ is a hydroxyl group, and alkoxy group having 1 to 6 carbon atoms or an alkyl group having 1 to 6 carbon atoms, and (4)

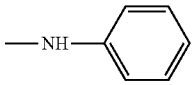

(5)

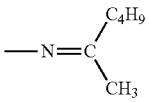

(6)

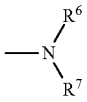

wherein in the chemical formula (6), $R^6$ is a hydrogen atom, an aminoalkyl group having 1 to 6 carbon atoms of an alkyl group having 1 to 6 carbon atoms, and $R^7$ is a hydrogen atom or an aminoalkyl group having 1 to 6 carbon atoms.

8. A surface treatment method comprising:

contacting a metal base material with a metal surface treatment composition to form a chemical conversion film on the metal base material, the metal surface treatment composition comprising:

(a) at least one of zirconium ions or titanium ions; and (b) at least one adhesive imparting agent comprising a polyamine compound;

at the time the metal base material is contacted with the metal surface treatment composition, in the metal surface treatment composition, conducting electrolytic treatment on the metal base material under atmospheric pressure or pressurized conditions with an applied voltage of 0.1 V to 40 V and an applied current density of 0.1 $A/dm^2$ to 30 $A/dm^2$; and applying a cathodic electrodeposition coating film onto fine portions of the metal base material with curves and bag portions;

wherein the total amount of the zirconium and titanium ions in the metal surface treatment composition is 10 ppm to 10000 ppm based on metal element content, wherein the metal surface treatment composition has a pH of 1.5 to 6.5, wherein the polyamine compound comprises at least one constituent unit represented by the chemical formula (3)

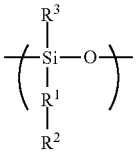

wherein the ratio of the total amount of the zirconium and/or titanium ions to the mass of the polyamine compound is 0.1 to 100, and wherein in the chemical formula (3), $R^1$ is an alkylene group having 1 to 6 carbon atoms, $R^2$ is a substituent group represented by the following chemical formulas (4) to (6) shown below, and $R^3$ is a hydroxyl group, an alkoxy group having 1 to 6 carbon atoms or an alkyl group having 1 to 6 carbon atoms, and (4)

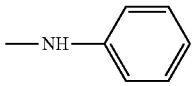

(5)

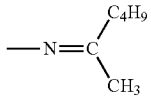

(6)

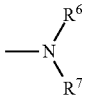

wherein in the chemical formula (6), $R^6$ is a hydrogen atom, an aminoalkyl group having 1 to 6 carbon atoms of an alkyl group having 1 to 6 carbon atoms, and $R^7$ is a hydrogen atom or an aminoalkyl group having 1 to 6 carbon atoms.

9. The surface treatment method according to claim 8, wherein the cathodic electrodeposition coating film is formed by electropainting with a cathodic electrodeposition coating material.

10. The surface treatment method according to claim 9, wherein the cathodic eletrodeposition coating material comprises a modified epoxy resin and a curing agent.

* * * * *